US005554423A

United States Patent [19]

Abate

[11] Patent Number: 5,554,423

[45] **Date of Patent: * Sep. 10, 1996**

[54] TUBULAR ELEMENT FOR THE FORMATION OF BAGS FOR THE VACUUM-PACKING

[76] Inventor: Luigi F. Abate, Via Colli Storici 67, S. Martino d/Battaglia (Brescia), Italy

[ * ] Notice: The portion of the term of this patent subsequent to Jul. 10, 2015, has been disclaimed.

[21] Appl. No.: 205,833

[22] Filed: Mar. 3, 1994

[30] Foreign Application Priority Data

Oct. 13, 1993 [IT] Italy ..... BS93U0074

[51] Int. Cl.[6] ..... B65D 33/02; B65D 81/20

[52] U.S. Cl. ..... 428/35.2; 428/35.4; 428/35.7; 428/107; 428/119; 428/123; 428/167; 428/175; 428/200; 428/476.1; 428/483; 428/516; 206/524.8; 383/119; 426/127; 426/415

[58] Field of Search ..... 428/35.2, 35.4, 428/36.1, 475.8, 483, 476.1, 516, 517, 192, 200, 167, 163, 175, 107, 35.7, 119, 123; 206/524.8; 426/415, 127; 383/119

[56] References Cited

U.S. PATENT DOCUMENTS

| | | | |
|---|---|---|---|
| 2,778,173 | 1/1957 | Taunton | 206/524.8 |
| 3,595,722 | 7/1971 | Dawbarn | 383/119 |
| 4,104,404 | 8/1978 | Bieler et al. | 428/35.2 |
| 4,220,684 | 9/1980 | Olson | 428/35.2 |
| 4,401,256 | 8/1983 | Krieg | 428/35.2 |
| 5,075,143 | 12/1991 | Bekele | 428/35.2 |
| 5,134,001 | 7/1992 | Osgood | 428/35.2 |
| 5,234,731 | 8/1993 | Ferguson | 428/35.4 |

*Primary Examiner*—Ellis Robinson
*Assistant Examiner*—Rena L. Dye
*Attorney, Agent, or Firm*—McGlew & Tuttle, P.C.

[57] ABSTRACT

The present utility model pertains to a tubular element for the formation of bags for the vacuum-packing of products, consisting of an inner layer or film (14) having thread-like elements (15), which extend along the length of the tubular element and are intended to be relief on at least on inner surface of the resulting bag and to define among themselves channels (16) for the evacuation, by suction, of air from the bag at the time of using the bag for the vacuum-packing of a product.

8 Claims, 1 Drawing Sheet

TUBULAR ELEMENT FOR THE FORMATION OF BAGS FOR THE VACUUM-PACKING

FIELD OF THE INVENTION

The present utility model pertains to packing materials, and more specifically, to an element for the formation of bags that are impermeable, heat-sealable and intended for the vacuum-packing of perishable products.

BACKGROUND OF THE INVENTION

Packing materials in the shape of tubular elements, which are sealed in the longitudinal direction by means of bonding and are capable of being shaped into bags for the above-mentioned use, have already been proposed. According to a known embodiment, the wall of the tubular element consists of at least two overlapping elements which are made of different materials, specifically an outer layer or film made of a material that is impermeable to gases and an inner layer or film made of a thermoplastic, heat-sealable material. The two layers are intimately overlapped, and at least the inner layer has an embossing or a network of channels, which promote the outlet of air at the time the bag is used for vacuum-packing. Therefore, the network of channels is obtained on the inner, heat-sealable layer of the element.

SUMMARY AND OBJECTS OF THE INVENTION

On the other hand, the object of the present invention is to provide a packing material with walls which are formed by two or more layers or films made of different plastic materials, and in which, with the impermeability and heat-sealability remaining constant, the channels for the discharge of air are defined by thread-like elements which are applied on at least one inner surface of the manufactured article. Thus, the embossing is eliminated, causing the bags for the vacuum-packing to be more simply and economically produced and to have reliable use.

According to the invention, a tubular bag element (a tubular element for the formation of bags) is provided, particularly for vacuum-packing of products. The tubular element is formed of at least one starting sheets, each including an outer layer of film, made of a plastic material that is impermeable to gas, and an inner film layer of film made of a thermoplastic material (a heat sealable material). The two starting sheets are provided such that the inner layers are in contact and connected by heat bonding. Thread like elements (plastic strands) are provided extending along the length of the tubular element, provided on the inner surface of one of the two starting sheets. Channels are formed between the extending strands assisting in the evacuation, by suction, of air from the bag at the time of vacuum-packing of a product.

The thread like elements or plastic strands are inserted on the inner layer film of one or both of the starting sheets and are provided spaced an equal distances along the entire inner surface of at least one of the two starting sheets.

The invention can be employed with nylon or polyester forming the outer sheet with the inner sheet being formed of polyethylene or polythene and wherein the thread like elements or plastic strands (which define the channels for vacuum packing) are made of the same material as the inner layer.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
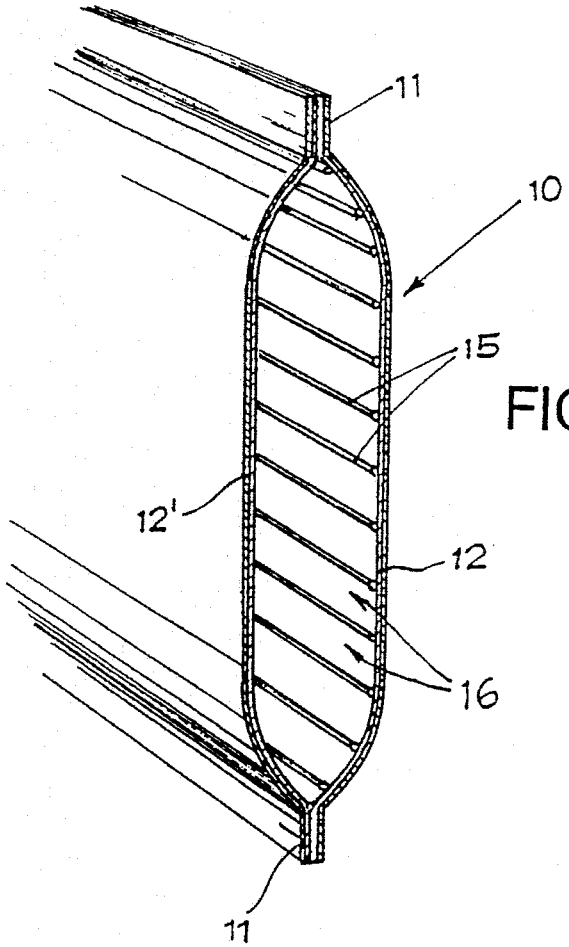
FIG. 1 is a perspective view a cut section of a tubular element intended to form a bag for the vacuum-packing of products.

In general terms, the tubular element under examination, indicated as a whole by 10, can be formed by one or by two sheets or bands and sealed in the longitudinal direction, by means of bonding, along one side or two sides, as indicated by 11. In the example shown, the tubular element consists of two sheets or bands 12, 12', sealed along two opposing sides. The tubular element is then cut to the desired length, sealed in the cross-sectional direction, by means of bonding, at one of its ends to form a bag and, at the time of use, at the opposite end, after having arranged the product to be packed and having created the vacuum.

The sheet or sheets, which contribute to the formation of the tubular element, and therefore also the formation of the resulting bag, is or are formed by an outer layer or film 13, which is made of a material, such as nylon or polyester, is airtight, that is, impermeable to gases, such as polyethylene or polythene, and is heat-sealable. The two layers or films 13, 14 are overlapped and intimately connected.

In accordance with the present invention, thread-like elements (strands) 15, which extend along the length of the sheet proper, are applied on the inner surface of at least one of the sheets 12, 12', for example, 12 in the drawing, and more precisely on the inner layer or film 14 made of polyethylene or polythene. The strands 15 are applied at least on the sheet 12, preferably before assembling the two sheets 12, 12' in order to form the tubular element and subsequently the bags. The strands 15 are preferably made of the same material, polyethylene or polythene, forming the inner layer or film 14, and they are inserted in a suitable manner, yet so as to be in relief on the inner surface of the tubular element 10 and therefore of the resulting bag.

Figure 2:
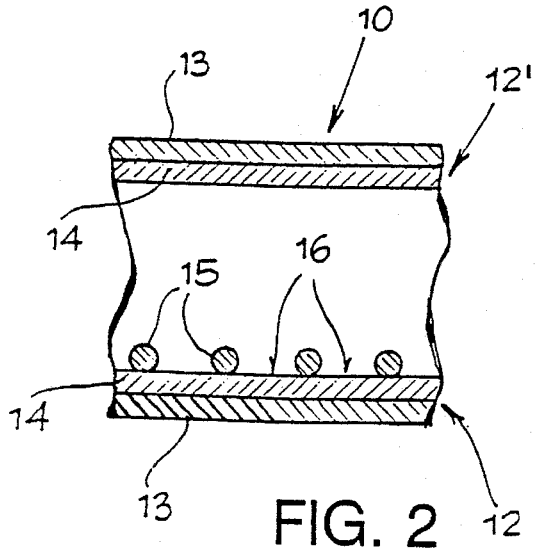
FIG. 2 is an enlarged detail of the cut section in FIG. 1.
Figure 3:
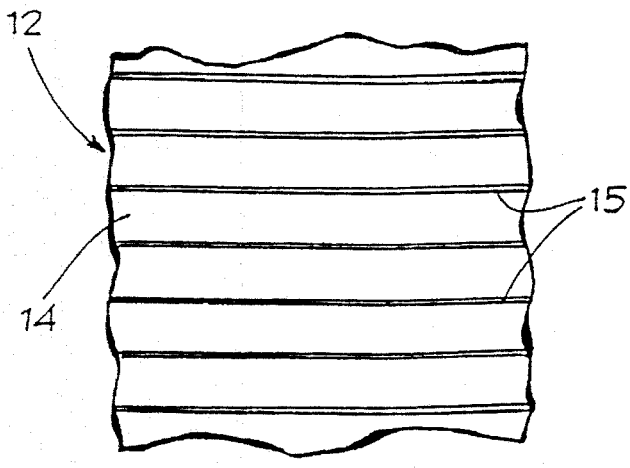
FIG. 3 is a partial view of the inner surface of the tubular element with channels defined by thread-like elements in relief.

Such an embodiment is illustrated in the drawings, from which it can be ascertained (FIGS. 1 and 2) how the thread-like elements define, on the inside of the tubular element and consequently of the bag, longitudinal channels 16 which permit a complete evacuation of the air, by suction, from the bag at the time of using the bag for the vacuum-packing of products with equipment which is known per se and does not merit particular attention here.

While a specific embodiment of the invention has been shown and described in detail to illustrate the application of the principles of the invention, it will be understood that the invention may be embodied otherwise without departing from such principles.

What is claimed is:

1. A tubular element for forming bags used for the vacuum-packing of products, comprising: a first starting sheet formed of an outer layer of film made of a plastic material that is impermeable to gas and formed of an inner layer of film made of a thermoplastic, heat-sealable material; a second starting sheet formed of an outer layer of film made of a plastic material which is impermeable to gas and an inner layer of film made of a thermoplastic, heat-sealable material, said inner layer of said first starting sheet being bonded to said inner layer of said second starting sheet along an upper edge of said first starting sheet and said second starting sheet and being bonded along a lower edge of said first starting sheet and said second starting sheet to provide upper and lower bonded edges, said bonded edges extending in a length direction and said first starting sheet and said second starting sheet and said bonded edges cooperating to define a tube with an interior region for receiving the product to be vacuum packaged; thermoplastic, heat-sealable strand elements heat bonded to an inner surface of said inner layer of one of said first starting sheet and said second starting sheet, said strands extending along a length of said tubular element substantially in parallel to said upper and lower bonded edges, said strands being spaced apart to define vacuum packing evacuation channels, each evacuation channel being formed between two adjacent strands.

2. Tubular element according to claim 1, wherein said strands are connected to said inner surface of said tubular element between said lower edge and said upper edge.

3. Tubular element according to claim 2, wherein said outer layer of film of each of said first starting sheet and said second starting sheet is formed of one of nylon and polyester and said inner layer of film of each of said first starting sheet and said second starting sheet is formed of polyethylene and said strands are made of the same material as said inner layer of film.

4. A tubular element for forming bags used for the vacuum-packing of products, comprising: a first starting sheet formed of an outer layer of film made of a plastic material that is impermeable to gas and formed of an inner layer of film made of a thermoplastic, heat-sealable material; a second starting sheet formed of an outer layer of film made of a plastic material which is impermeable to gas and an inner layer of film made of a thermoplastic, heat-sealable material, said inner layer of said first starting sheet being bonded to said inner layer of said second starting sheet along an upper edge of said first starting sheet and said second starting sheet and being bonded along a lower edge of said first starting sheet and said second starting sheet to provide upper and lower bonded edges, said bonded edges extending in a length direction and said first starting sheet and said second starting sheet and said bonded edges cooperating to define a tube with an interior region for receiving the product to be vacuum packaged; thermoplastic, heat-sealable strand elements heat bonded to an inner surface of said inner layer of one of said first starting sheet and said second starting sheet, said strands extending along a length of said tubular element substantially in parallel to said upper and lower bonded edges and extending away from said inner surface, said strands being spaced apart to define vacuum packing evacuation channels, each evacuation channel being formed between two adjacent strands.

5. Tubular element according to claim 4, wherein said strands are connected to said inner surface of said tubular element between said lower edge to said upper edge.

6. Tubular element according to claim 5, wherein said outer layer of film of each of said first starting sheet and said second starting sheet is formed of one of nylon and polyester and said inner layer of film of each of said first starting sheet and said second starting sheet is formed of polyethylene and said strands are made of the same material as said inner layer of film.

7. A tubular element for forming bags used for the vacuum-packing of products, comprising: a first starting sheet formed of an outer layer of film made of a plastic material that is impermeable to gas and formed of an inner layer of film made of a thermoplastic, heat-sealable material; a second starting sheet formed of an outer layer of film made of a plastic material which is impermeable to gas and an inner layer of film made of a thermoplastic, heat-sealable material, said inner layer of said first starting sheet being bonded to said inner layer of said second starting sheet along an upper edge of said first starting sheet and said second starting sheet and being bonded along a lower edge of said first starting sheet and said second starting sheet to form bonded edges, said bonded edges extending in a length direction and said first starting sheet and said second starting sheet and said bonded edges cooperating to define a tube with an interior region for receiving the product to be vacuum packaged; thermoplastic, heat-sealable strand elements heat bonded on an inner surface of said inner layer of one of said first starting sheet and said second starting sheet extending along a length of said tubular element substantially in parallel to said upper and lower bonded edges and, said strands extending outwardly from said inner surface, said strands being spaced apart to define vacuum packing evacuation channels, each evacuation channel being formed between two adjacent strands, said inner layer of film of each of said first starting sheet and said second starting sheet being formed of polyethylene and said strands being made of the same material as said inner layer of film.

8. Tubular element according to claim 7, wherein said strands are connected to said inner surface of said tubular element between said lower bonded edge to said upper bonded edge.

* * * * *